US010704364B2

(12) United States Patent
Zouhair

(10) Patent No.: US 10,704,364 B2
(45) Date of Patent: Jul. 7, 2020

(54) COUPLER WITH THREADED CONNECTION FOR PIPE HANDLER

(71) Applicant: Weatherford Technology Holdings, LLC, Houston, TX (US)

(72) Inventor: Aicam Zouhair, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 15/444,016

(22) Filed: Feb. 27, 2017

(65) Prior Publication Data

US 2018/0245432 A1 Aug. 30, 2018

(51) Int. Cl.
*E21B 41/00* (2006.01)
*E21B 17/046* (2006.01)
*E21B 3/02* (2006.01)

(52) U.S. Cl.
CPC ..... *E21B 41/00* (2013.01); *E21B 3/02* (2013.01); *E21B 17/046* (2013.01)

(58) Field of Classification Search
CPC ..... E21B 41/00; E21B 3/02
See application file for complete search history.

(56) References Cited

U.S. PATENT DOCUMENTS 1,367,156 A 2/1921 McAlvay et al.
1,610,977 A 12/1926 Scott
1,822,444 A 9/1931 MacClatchie
2,370,354 A 2/1945 Hurst
3,147,992 A 9/1964 Haeber et al.
3,354,951 A 11/1967 Savage et al.
3,385,370 A 5/1968 Knox et al.
3,662,842 A 5/1972 Bromell
3,698,426 A 10/1972 Litchfield et al.
3,747,675 A 7/1973 Brown
3,766,991 A 10/1973 Brown
3,774,697 A 11/1973 Brown
(Continued)

FOREIGN PATENT DOCUMENTS

AU 2012201644 A1 4/2012
AU 2013205714 A1 5/2013
(Continued)

OTHER PUBLICATIONS

A123 System; 14Ah Prismatic Pouch Cell; Nanophosphate® Lithium-Ion; www.a123systems.com; date unknown; 1 page.
(Continued)

*Primary Examiner* — D. Andrews
*Assistant Examiner* — Manuel C Portocarrero
(74) *Attorney, Agent, or Firm* — Patterson + Sheridan, LLC

(57) ABSTRACT

A coupler includes a housing having a bore therethrough, a lock member at least partially disposed within the bore of the housing and longitudinally movable relative to the housing between a locked position and an unlocked position, and an actuator at least partially disposed within the housing and configured to move the lock member. In another embodiment, a combined multi-coupler system includes a housing having a bore therethrough, an adapter of a tool dock, and a locking assembly including a lock member at least partially disposed within the bore of the housing and longitudinally movable relative to the housing between a locked position and an unlocked position.

24 Claims, 5 Drawing Sheets

(56) References Cited

U.S. PATENT DOCUMENTS 3,776,320 A 12/1973 Brown
3,842,619 A 10/1974 Bychurch, Sr.
3,888,318 A 6/1975 Brown
3,899,024 A 8/1975 Tonnelli et al.
3,913,687 A 10/1975 Gyongyosi et al.
3,915,244 A 10/1975 Brown
3,964,552 A 6/1976 Slator
4,022,284 A 5/1977 Crow
4,051,587 A 10/1977 Boyadjieff
4,100,968 A 7/1978 Delano
4,192,155 A 3/1980 Gray
4,199,847 A 4/1980 Owens
4,235,469 A 11/1980 Denny et al.
4,364,407 A 12/1982 Hilliard
4,377,179 A 3/1983 Giebeler
4,402,239 A 9/1983 Mooney
4,449,596 A 5/1984 Boyadjieff
4,478,244 A 10/1984 Garrett
4,497,224 A 2/1985 Jürgens
4,593,773 A 6/1986 Skeie
4,762,187 A 8/1988 Haney
4,776,617 A 10/1988 Sato
4,779,688 A 10/1988 Baugh
4,791,997 A 12/1988 Krasnov
4,813,493 A 3/1989 Shaw et al.
4,815,546 A 3/1989 Haney et al.
4,821,814 A 4/1989 Willis et al.
4,844,181 A 7/1989 Bassinger
4,867,236 A 9/1989 Haney et al.
4,955,949 A 9/1990 Bailey et al.
4,962,819 A 10/1990 Bailey et al.
4,972,741 A 11/1990 Sibille
4,981,180 A 1/1991 Price
4,997,042 A 3/1991 Jordan et al.
5,036,927 A 8/1991 Willis
5,099,725 A 3/1992 Bouligny, Jr. et al.
5,152,554 A 10/1992 LaFleur et al.
5,172,940 A 12/1992 Usui
5,191,939 A 3/1993 Stokley
5,215,153 A 6/1993 Younes
5,245,877 A 9/1993 Ruark
5,282,653 A 2/1994 LaFleur et al.
5,297,833 A 3/1994 Willis et al.
5,348,351 A 9/1994 LaFleur et al.
5,385,514 A 1/1995 Dawe
5,433,279 A 7/1995 Tessari et al.
5,441,310 A 8/1995 Barrett et al.
5,456,320 A 10/1995 Baker
5,479,988 A 1/1996 Appleton
5,486,223 A 1/1996 Carden
5,501,280 A 3/1996 Brisco
5,509,442 A 4/1996 Claycomb
5,577,566 A 11/1996 Albright et al.
5,584,343 A 12/1996 Coone
5,645,131 A 7/1997 Trevisani
5,664,310 A 9/1997 Penisson
5,682,952 A 11/1997 Stokley
5,735,348 A 4/1998 Hawkins, III
5,778,742 A 7/1998 Stuart
5,839,330 A 11/1998 Stokka
5,909,768 A 6/1999 Castille et al.
5,918,673 A 7/1999 Hawkins et al.
5,950,724 A 9/1999 Giebeler
5,971,079 A 10/1999 Mullins
5,992,520 A 11/1999 Schultz et al.
6,003,412 A 12/1999 Dlask et al.
6,053,191 A 4/2000 Hussey
6,102,116 A 8/2000 Giovanni
6,142,545 A 11/2000 Penman et al.
6,161,617 A 12/2000 Gjedebo
6,173,777 B1 1/2001 Mullins
6,276,450 B1 8/2001 Seneviratne
6,279,654 B1 8/2001 Mosing et al.
6,289,911 B1 9/2001 Majkovic
6,309,002 B1 10/2001 Bouligny
6,311,792 B1 11/2001 Scott et al.
6,328,343 B1 12/2001 Hosie et al.
6,378,630 B1 4/2002 Ritorto et al.
6,390,190 B2 5/2002 Mullins
6,401,811 B1 6/2002 Coone
6,415,862 B1 7/2002 Mullins
6,431,626 B1 8/2002 Bouligny
6,443,241 B1 9/2002 Juhasz et al.
6,460,620 B1 10/2002 LaFleur
6,527,047 B1 3/2003 Pietras
6,536,520 B1 3/2003 Snider et al.
6,571,876 B2 6/2003 Szarka
6,578,632 B2 6/2003 Mullins
6,595,288 B2 7/2003 Mosing et al.
6,604,578 B2 8/2003 Mullins
6,622,796 B1 9/2003 Pietras
6,637,526 B2 10/2003 Juhasz et al.
6,640,824 B2 11/2003 Majkovic
6,666,273 B2 12/2003 Laurel
6,675,889 B1 1/2004 Mullins et al.
6,679,333 B2 1/2004 York et al.
6,688,398 B2 2/2004 Pietras
6,691,801 B2 2/2004 Juhasz et al.
6,705,405 B1 3/2004 Pietras
6,715,542 B2 4/2004 Mullins
6,719,046 B2 4/2004 Mullins
6,722,425 B2 4/2004 Mullins
6,725,938 B1 4/2004 Pietras
6,732,819 B2 5/2004 Wenzel
6,732,822 B2 5/2004 Slack et al.
6,742,584 B1 6/2004 Appleton
6,742,596 B2 6/2004 Haugen
6,779,599 B2 8/2004 Mullins et al.
6,832,656 B2 12/2004 Fournier, Jr. et al.
6,883,605 B2 4/2005 Arceneaux et al.
6,892,835 B2 5/2005 Shahin et al.
6,908,121 B2 6/2005 Hirth et al.
6,925,807 B2 8/2005 Jones et al.
6,938,697 B2 9/2005 Haugen
6,976,298 B1 12/2005 Pietras
6,994,176 B2 2/2006 Shahin et al.
7,000,503 B2 2/2006 Dagenais et al.
7,001,065 B2 2/2006 Dishaw et al.
7,004,259 B2 2/2006 Pietras
7,007,753 B2 3/2006 Robichaux et al.
7,017,671 B2 3/2006 Williford
7,021,374 B2 4/2006 Pietras
7,025,130 B2 4/2006 Bailey et al.
7,073,598 B2 7/2006 Haugen
7,090,021 B2 8/2006 Pietras
7,096,948 B2 8/2006 Mosing et al.
7,114,235 B2 10/2006 Jansch et al.
7,128,161 B2 10/2006 Pietras
7,137,454 B2 11/2006 Pietras
7,140,443 B2 11/2006 Beierbach et al.
7,143,849 B2 12/2006 Shahin et al.
7,147,254 B2 12/2006 Niven et al.
7,159,654 B2 1/2007 Ellison et al.
7,178,612 B2 2/2007 Belik
7,213,656 B2 5/2007 Pietras
7,219,744 B2 5/2007 Pietras
7,231,969 B2 6/2007 Folk et al.
7,270,189 B2 9/2007 Brown et al.
7,281,451 B2 10/2007 Schulze Beckinghausen
7,281,587 B2 10/2007 Haugen
7,303,022 B2 12/2007 Tilton et al.
7,325,610 B2 2/2008 Giroux et al.
7,353,880 B2 4/2008 Pietras
7,448,456 B2 11/2008 Shahin et al.
7,451,826 B2 11/2008 Pietras
7,490,677 B2 2/2009 Buytaert et al.
7,503,397 B2 3/2009 Giroux et al.
7,509,722 B2 3/2009 Shahin et al.
7,513,300 B2 4/2009 Pietras et al.
7,591,304 B2 9/2009 Juhasz et al.
7,617,866 B2 11/2009 Pietras
7,635,026 B2 12/2009 Mosing et al.
7,665,515 B2 2/2010 Mullins
7,665,530 B2 2/2010 Wells et al.

(56) References Cited

U.S. PATENT DOCUMENTS 7,665,531 B2 2/2010 Pietras
7,669,662 B2 3/2010 Pietras
7,690,422 B2 4/2010 Swietlik et al.
7,694,730 B2 4/2010 Angman
7,694,744 B2 4/2010 Shahin
7,699,121 B2 4/2010 Juhasz et al.
7,712,523 B2 5/2010 Snider et al.
7,730,698 B1 6/2010 Montano et al.
7,757,759 B2 7/2010 Jahn et al.
7,779,922 B1 8/2010 Harris et al.
7,793,719 B2 9/2010 Snider et al.
7,817,062 B1 10/2010 Li et al.
7,828,085 B2 11/2010 Kuttel et al.
7,841,415 B2 11/2010 Winter
7,854,265 B2 12/2010 Zimmermann
7,866,390 B2 1/2011 Latiolais, Jr. et al.
7,874,352 B2 1/2011 Odell, II et al.
7,874,361 B2 1/2011 Mosing et al.
7,878,237 B2 2/2011 Angman
7,878,254 B2 2/2011 Abdollahi et al.
7,882,902 B2 2/2011 Boutwell, Jr.
7,896,084 B2 3/2011 Haugen
7,918,273 B2 4/2011 Snider et al.
7,958,787 B2 6/2011 Hunter
7,971,637 B2 7/2011 Duhon et al.
7,975,768 B2 7/2011 Fraser et al.
8,118,106 B2 2/2012 Wiens et al.
8,141,642 B2 3/2012 Olstad et al.
8,210,268 B2 7/2012 Heidecke et al.
8,281,856 B2 10/2012 Jahn et al.
8,307,903 B2 11/2012 Redlinger et al.
8,365,834 B2 2/2013 Liess et al.
8,459,361 B2 6/2013 Leuchtenberg
8,505,984 B2 8/2013 Henderson et al.
8,567,512 B2 10/2013 Odell, II et al.
8,601,910 B2 12/2013 Begnaud
8,636,067 B2 1/2014 Robichaux et al.
8,651,175 B2 2/2014 Fallen
8,668,003 B2 3/2014 Osmundsen et al.
8,708,055 B2 4/2014 Liess et al.
8,727,021 B2 5/2014 Heidecke et al.
8,776,898 B2 7/2014 Liess et al.
8,783,339 B2 7/2014 Sinclair et al.
8,839,884 B2 9/2014 Kuttel et al.
8,893,772 B2 11/2014 Henderson et al.
9,068,406 B2 6/2015 Clasen et al.
9,206,851 B2 12/2015 Slaughter, Jr. et al.
9,528,326 B2 12/2016 Heidecke et al.
9,631,438 B2 4/2017 McKay
2002/0043403 A1 4/2002 Juhasz et al.
2002/0074132 A1 6/2002 Juhasz et al.
2002/0084069 A1 7/2002 Mosing et al.
2002/0129934 A1 9/2002 Mullins et al.
2002/0170720 A1 11/2002 Haugen
2003/0098150 A1 5/2003 Andreychuk
2003/0107260 A1 6/2003 Ording et al.
2003/0221519 A1 12/2003 Haugen
2004/0003490 A1 1/2004 Shahin et al.
2004/0069497 A1 4/2004 Jones et al.
2004/0216924 A1 11/2004 Pietras et al.
2005/0000691 A1 1/2005 Giroux et al.
2005/0173154 A1 8/2005 Lesko
2005/0206163 A1 9/2005 Guesnon et al.
2005/0257933 A1 11/2005 Pietras
2005/0269072 A1 12/2005 Folk
2005/0269104 A1 12/2005 Folk et al.
2005/0269105 A1 12/2005 Pietras
2005/0274508 A1 12/2005 Folk
2006/0037784 A1 2/2006 Walter et al.
2006/0124353 A1 6/2006 Juhasz et al.
2006/0151181 A1 7/2006 Shahin
2006/0180315 A1 8/2006 Shahin et al.
2007/0030167 A1 2/2007 Li et al.
2007/0044973 A1 3/2007 Fraser et al.
2007/0074588 A1 4/2007 Harata et al.
2007/0074874 A1 4/2007 Richardson
2007/0102992 A1 5/2007 Jager
2007/0131416 A1 6/2007 Odell, II et al.
2007/0140801 A1 6/2007 Kuttel et al.
2007/0144730 A1 6/2007 Shahin et al.
2007/0158076 A1 7/2007 Hollingsworth, Jr. et al.
2007/0251699 A1* 11/2007 Wells ..... E21B 19/16 166/377
2007/0251701 A1 11/2007 Jahn et al.
2007/0257811 A1 11/2007 Hall et al.
2008/0059073 A1 3/2008 Giroux et al.
2008/0093127 A1 4/2008 Angman
2008/0099196 A1 5/2008 Latiolais et al.
2008/0125876 A1 5/2008 Boutwell
2008/0202812 A1 8/2008 Childers et al.
2008/0308281 A1 12/2008 Boutwell, Jr. et al.
2009/0151934 A1 6/2009 Heidecke et al.
2009/0159294 A1 6/2009 Abdollahi et al.
2009/0200038 A1 8/2009 Swietlik et al.
2009/0205820 A1 8/2009 Koederitz et al.
2009/0205827 A1 8/2009 Swietlik et al.
2009/0205836 A1 8/2009 Swietlik et al.
2009/0205837 A1 8/2009 Swietlik et al.
2009/0229837 A1 9/2009 Wiens et al.
2009/0266532 A1 10/2009 Revheim et al.
2009/0272537 A1 11/2009 Alikin et al.
2009/0274544 A1 11/2009 Liess
2009/0274545 A1 11/2009 Liess et al.
2009/0316528 A1 12/2009 Ramshaw et al.
2009/0321086 A1* 12/2009 Zimmermann ..... E21B 19/07 166/379
2010/0032162 A1 2/2010 Olstad et al.
2010/0101805 A1 4/2010 Angelle et al.
2010/0200222 A1 8/2010 Robichaux et al.
2010/0206583 A1 8/2010 Swietlik et al.
2010/0206584 A1 8/2010 Clubb et al.
2010/0236777 A1 9/2010 Partouche et al.
2011/0036586 A1 2/2011 Hart et al.
2011/0039086 A1 2/2011 Graham et al.
2011/0088495 A1 4/2011 Buck et al.
2011/0214919 A1 9/2011 McClung, III
2011/0280104 A1 11/2011 McClung, III
2012/0048574 A1 3/2012 Wiens et al.
2012/0152530 A1 6/2012 Vviedecke et al.
2012/0160517 A1 6/2012 Bouligny et al.
2012/0212326 A1 8/2012 Christiansen et al.
2012/0234107 A1 9/2012 Pindiprolu et al.
2012/0298376 A1 11/2012 Twardowski
2013/0055858 A1 3/2013 Richardson
2013/0056977 A1 3/2013 Henderson et al.
2013/0062074 A1 3/2013 Angelle et al.
2013/0075077 A1 3/2013 Henderson et al.
2013/0075106 A1 3/2013 Tran et al.
2013/0105178 A1 5/2013 Pietras
2013/0207382 A1 8/2013 Robichaux
2013/0207388 A1 8/2013 Jansson et al.
2013/0233624 A1 9/2013 In
2013/0269926 A1 10/2013 Liess et al.
2013/0271576 A1 10/2013 Elllis
2013/0275100 A1 10/2013 Ellis et al.
2013/0299247 A1 11/2013 Küttel et al.
2014/0090856 A1 4/2014 Pratt et al.
2014/0116686 A1 5/2014 Odell, II et al.
2014/0131052 A1 5/2014 Richardson
2014/0202767 A1 7/2014 Feasey
2014/0233804 A1 8/2014 Gustavsson et al.
2014/0262521 A1 9/2014 Bradley et al.
2014/0305662 A1 10/2014 Giroux et al.
2014/0326468 A1 11/2014 Heidecke et al.
2014/0352944 A1 12/2014 Devarajan et al.
2014/0360780 A1 12/2014 Moss et al.
2015/0014063 A1 1/2015 Simanjuntak et al.
2015/0053424 A1 2/2015 Wiens et al.
2015/0083391 A1 3/2015 Bangert et al.
2015/0107385 A1 4/2015 Mullins et al.
2015/0337648 A1 11/2015 Zippel et al.
2016/0024862 A1 1/2016 Wilson et al.
2016/0138348 A1 5/2016 Kunec
2016/0145954 A1 5/2016 Helms et al.

(56) References Cited

U.S. PATENT DOCUMENTS

| | | | |
|---|---|---|---|
| 2016/0177639 | A1 | 6/2016 | McIntosh et al. |
| 2016/0215592 | A1 | 7/2016 | Helms et al. |
| 2016/0230481 | A1 | 8/2016 | Misson et al. |
| 2017/0037683 | A1 | 2/2017 | Heidecke et al. |
| 2017/0044854 | A1 | 2/2017 | Hebebrand et al. |
| 2017/0044875 | A1 | 2/2017 | Hebebrand et al. |
| 2017/0051568 | A1 | 2/2017 | Wern et al. |
| 2017/0067303 | A1 | 3/2017 | Thiemann et al. |
| 2017/0067320 | A1* | 3/2017 | Zouhair ..... E21B 41/00 |
| 2017/0074075 | A1 | 3/2017 | Liess |
| 2017/0211327 | A1 | 7/2017 | Wern et al. |
| 2017/0211343 | A1 | 7/2017 | Thiemann |
| 2017/0284164 | A1 | 10/2017 | Holmes et al. |

FOREIGN PATENT DOCUMENTS

| | | | |
|---|---|---|---|
| AU | 2014215938 | A1 | 9/2014 |
| CA | 2 707 050 | A1 | 6/2009 |
| CA | 2 841 654 | A1 | 8/2015 |
| CA | 2944327 | A1 | 10/2015 |
| DE | 102007016822 | A1 | 10/2008 |
| EP | 0 250 072 | A2 | 12/1987 |
| EP | 1 619 349 | A2 | 1/2006 |
| EP | 1 772 715 | A2 | 4/2007 |
| EP | 1 961 912 | A1 | 8/2008 |
| EP | 1 961 913 | A1 | 8/2008 |
| EP | 2085566 | A2 | 8/2009 |
| EP | 2 322 357 | A1 | 5/2011 |
| EP | 3032025 | A1 | 6/2016 |
| GB | 1487948 | A | 10/1977 |
| GB | 2 077 812 | A | 12/1981 |
| GB | 2 180 027 | A | 3/1987 |
| GB | 2 228 025 | A | 8/1990 |
| GB | 2 314 391 | A | 12/1997 |
| WO | 2004/079153 | A2 | 9/2004 |
| WO | 2004/101417 | A2 | 11/2004 |
| WO | 2007/001887 | A2 | 1/2007 |
| WO | 2007/070805 | A2 | 6/2007 |
| WO | 2007127737 | A2 | 11/2007 |
| WO | 2008005767 | A1 | 1/2008 |
| WO | 2009/076648 | A2 | 6/2009 |
| WO | 2012100019 | A1 | 7/2012 |
| WO | 2012/115717 | A2 | 8/2012 |
| WO | 2014056092 | A1 | 4/2014 |
| WO | 2015/000023 | A1 | 1/2015 |
| WO | 2015/119509 | A1 | 8/2015 |
| WO | 2015/127433 | A1 | 8/2015 |
| WO | 2015176121 | A1 | 11/2015 |
| WO | 2016197255 | A1 | 12/2016 |
| WO | 2017/044384 | A1 | 3/2017 |

OTHER PUBLICATIONS

Streicher Load/Torque Cell Systems; date unknown; 1 page.
3PS, Inc.; Enhanced Torque and Tension Sub with Integrated Turns; date unknown; 2 total pages.
Lefevre, et al.; Drilling Technology; Deeper, more deviated wells push development of smart drill stem rotary shouldered connections; dated 2008; 2 total pages.
PCT Invitaiton to Pay Additional Fees for International Application No. PCT/US2008/086699; dated Sep. 9, 2009; 7 total pages.
PCT Notification of Transmittal of the International Search Report and the Written Opinion of the International Searching Authority for International Application No. PCT/US2008/086699; dated Sep. 11, 2009; 19 total pages.
National Oilwell Varco; Rotary Shoulder Handbook; dated 2010; 116 total pages.
Weatherford; TorkSub™ Stand-Alone Torque Measuring System; dated 2011-2014; 4 total pages.
Australian Examination Report for Application No. 2008334992; dated Apr. 5, 2011; 2 total pages.
European Search Report for Application No. 08 860 261.0-2315; dated Apr. 12, 2011; 4 total pages.
Eaton; Spool Valve Hydraulic Motors; dated Sep. 2011; 16 total pages.
European Extended Search Report for Application No. 12153779.9-2315; dated Apr. 5, 2012; 4 total pages.
Australian Examination Report for Application No. 2012201644; dated May 15, 2013; 3 total pages.
Warrior; 250E Electric Top Drive (250-TON); 250H Hydraulic Top Drive (250-TON); dated Apr. 2014; 4 total pages.
Hydraulic Pumps & Motors; Fundamentals of Hydraulic Motors; dated Jun. 26, 2014; 6 total pages.
Warrior; Move Pipe Better; 500E Electric Top Drive (500 ton—1000 hp); dated May 2015; 4 total pages.
Canadian Office Action for Application No. 2,837,581; dated Aug. 24, 2015; 3 total pages.
European Extended Search Report for Application No. 15166062.8-1610; dated Nov. 23, 2015; 6 total pages.
Australian Examination Report for Application No. 2014215938; dated Feb. 4, 2016; 3 total pages.
Rexroth; Bosch Group; Motors and Gearboxes; Asynchronous high-speed motors 1 MB for high speeds; dated Apr. 13, 2016; 6 total pages.
Canadian Office Action for Application No. 2,837,581; dated Apr. 25, 2016; 3 total pages.
PCT Notification of Transmittal of the International Search Report and the Written Opinion of the International Searching Authority for International Application No. PCT/US2015/061960; dated Jul. 25, 2016; 16 total pages.
PCT Notification of Transmittal of the International Search Report and the Written Opinion of the International Searching Authority for International Application No. PCT/US2016/049462; dated Nov. 22, 2016; 14 total pages.
PCT Notification of Transmittal of the International Search Report and the Written Opinion of the International Searching Authority for International Application No. PCT/US2016/050542; dated Nov. 25, 2016; 13 total pages.
PCT Notification of Transmittal of the International Search Report and the Written Opinion of the International Searching Authority for International Application No. PCT/US2016/046458; dated Dec. 14, 2016; 16 total pages.
PCT Notification of Transmittal of the International Search Report and the Written Opinion of the International Searching Authority for International Application No. PCT/US2016/047813; dated Jan. 12, 2017; 15 total pages.
PCT Notification of Transmittal of the International Search Report and the Written Opinion of the International Searching Authority for International Application No. PCT/US2016/050139; dated Feb. 20, 2017; 20 total pages.
PCT Notification of Transmittal of the International Search Report and the Written Opinion of the International Searching Authority for International Application No. PCT/US2017/014646; dated Apr. 4, 2017; 14 total pages.
PCT Notification of Transmittal of the International Search Report and the Written Opinion of the International Searching Authority for International Application No. PCT/US2017/014224; dated Jun. 8, 2017; 15 total pages.
European Extended Search Report for Application No. 17152458.0-1609; dated Jun. 8, 2017; 7 total pages.
Australian Examination Report for Application No. 2017200371; dated Sep. 19, 2017; 5 total pages.
European Extended Search Report for Application No. 17195552.9-1614; dated Dec. 4, 2017; 6 total pages.
Australian Examination Report for Application No. 2017200371; dated Feb. 8, 2018; 6 total pages.
Canadian Office Action for Application No. 2,955,754; dated Mar. 28, 2018; 3 total pages.
Australian Examination Report for Application No. 2017200371; dated May 2, 2018; 4 total pages.
Canadian Office Action for Application No. 2,974,298; dated May 16, 2018; 3 total pages.
Canadian Office Action in related application CA 2,955,754 dated Jul. 17, 2018.
EPO Extended European Search Report dated Jul. 19, 2018, for European Application No. 18159595.0.

(56) References Cited

OTHER PUBLICATIONS

EPO Extended European Search Report dated Jul. 17, 2018, for European Application No. 181580507.
Cookson, Colter, "Inventions Speed Drilling, Cut Costs," The American Oil & Gas Reporter, Sep. 2015, 2 pages.
Ennaifer, Amine et al. , "Step Change in Well Testing Operations," Oilfield Review, Autumn 2014: 26, No. 3, pp. 32-41.
Balltec Lifting Solutions, LiftLOK™ Brochure, "Highest integrity lifting tools for the harshest environments," 2 pages.
Balltec Lifting Solutions, CoilLOK™ Brochure, "Highest integrity hand-held coiled tubing handling tools," 2 pages.
Peters; Tool Coupler for Use With a Top Drive; U.S. Appl. No. 15/656,508, filed Jul. 21, 2017. (Application not attached to IDS.).
Fuehring et al.; Tool Coupler With Rotating Coupling Method for Top Drive; U.S. Appl. No. 15/445,758, filed Feb. 28, 2017. (Application not attached to IDS.).
Bell; Interchangeable Swivel Combined Multicoupler; U.S. Appl. No. 15/607,159, filed May 26, 2017 (Application not attached to IDS.).
Amezaga; Dual Torque Transfer for Top Drive System; U.S. Appl. No. 15/447,881, filed Mar. 2, 2017. (Application not attached to IDS.).
Zouhair; Coupler With Threaded Connection for Pipe Handler; U.S. Appl. No. 15/444,016, filed Feb. 27, 2017. (Application not attached to IDS.).
Liess; Downhole Tool Coupling System; U.S. Appl. No. 15/670,897, filed Aug. 7, 2017. (Application not attached to IDS.).
Muller et al; Combined Multi-Coupler With Rotating Locking Method for Top Drive; U.S. Appl. No. 15/721,216, filed Sep. 29, 2017. (Application not attached to IDS.).
Amezaga et al; Tool Coupler With Threaded Connection for Top Drive; U.S. Appl. No. 15/457,572, filed Mar. 13, 2017. (Application not attached to IDS.).
Wiens; Combined Multi-Coupler With Locking Clamp Connection for Top Drive; U.S. Appl. No. 15/627,428, filed Jun. 19, 2017. (Application not attached to IDS.).
Henke et al.; Tool Coupler With Sliding Coupling Members for Top Drive; U.S. Appl. No. 15/448,297, filed Mar. 2, 2017. (Application not attached to IDS.).
Schoknecht et al.; Combined Multi-Coupler With Rotating Fixations for Top Drive; U.S. Appl. No. 15/447,926, filed Mar. 2, 2017. (Application not attached to IDS.).
Metzlaff et al.; Combined Multi-Coupler for Top Drive; U.S. Appl. No. 15/627,237, filed Jun. 19, 2017. (Application not attached to IDS.).
Liess; Combined Multi-Coupler for Top Drive; U.S. Appl. No. 15/656,914, filed Jul. 21, 2017. (Application not attached to IDS.).
Liess et al.; Combined Multi-Coupler; U.S. Appl. No. 15/656,684, filed Jul. 21, 2017. (Application not attached to IDS).
Amezaga et al.; Tool Coupler With Data and Signal Transfer Methods for Top Drive; U.S. Appl. No. 15/730,305, filed Oct. 11, 2017. (Application not attached to IDS).
Liess; Tool Coupler With Threaded Connection for Top Drive; U.S. Appl. No. 15/806,560, filed Nov. 8, 2017. (Application not attached to IDS).
EPO Partial European Search Report dated Jul. 31, 2018, for European Application No. 18159597.6.
European Patent Office; Extended Search Report for Application No. 18160808.4; dated Sep. 20, 2018; 8 total pages.
EPO Partial European Search Report dated Oct. 4, 2018, for European Patent Application No. 18159598.4.
EPO Extended European Search Report dated Oct. 5, 2018, for European Patent Application No. 18173275.1.
EPO Extended European Search Report dated Nov. 6, 2018, for European Application No. 18159597.6.
International Search Report and Written Opinion in PCT/US2018/042812 dated Oct. 17, 2018.
Extended Search Report in application EP18177312.8 dated Nov. 6, 2018.
EPO Extended European Search Report dated Jun. 6, 2018, for European Application No. 18157915.2.
European OA in related application EP 18157915.2 dated Jul. 12, 2019.

* cited by examiner

COUPLER WITH THREADED CONNECTION FOR PIPE HANDLER

BACKGROUND OF THE INVENTION

Field of the Invention

The present disclosure generally relates to methods and apparatus for coupling a top drive to a tool for use in a wellbore.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed, and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Top drives are equipped with a motor for rotating the drill string. The quill of the top drive is typically threaded for connection to an upper end of the drill pipe in order to transmit torque to the drill string. Conventional top drives also threadedly connect to tools for use in the wellbore. An operator on the rig may be required to connect supply lines, such as hydraulic, electric, pneumatic, data, and/or power lines, between conventional top drives and the tool to complete the connection. The threaded connection between top conventional top drives and tools allows only for rotation in a single direction. Manual connection of supply lines can be time-consuming and dangerous to rig personnel. Therefore, there is a need for improved apparatus and methods for connecting top drives to tools.

SUMMARY OF THE INVENTION

In one or more of the embodiments described herein, a coupler for a top drive includes a housing having a bore therethrough, a lock member at least partially disposed within the bore of the housing and longitudinally movable relative to the housing between a locked position and an unlocked position, and an actuator at least partially disposed within the housing and configured to move the lock member.

In another embodiment, a combined multi-coupler system includes, a coupler for a top drive having a housing with a bore therethrough, an adapter of a tool, and a lock member at least partially disposed within the bore of the housing and longitudinally movable relative to the housing to couple the housing and the adapter.

In another embodiment, a method for coupling a top drive to a tool includes inserting an adapter of a tool into a housing of a coupler for a top drive, moving a lock member longitudinally relative to the housing, and engaging the adapter with the lock member to couple the adapter and the housing.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 2:
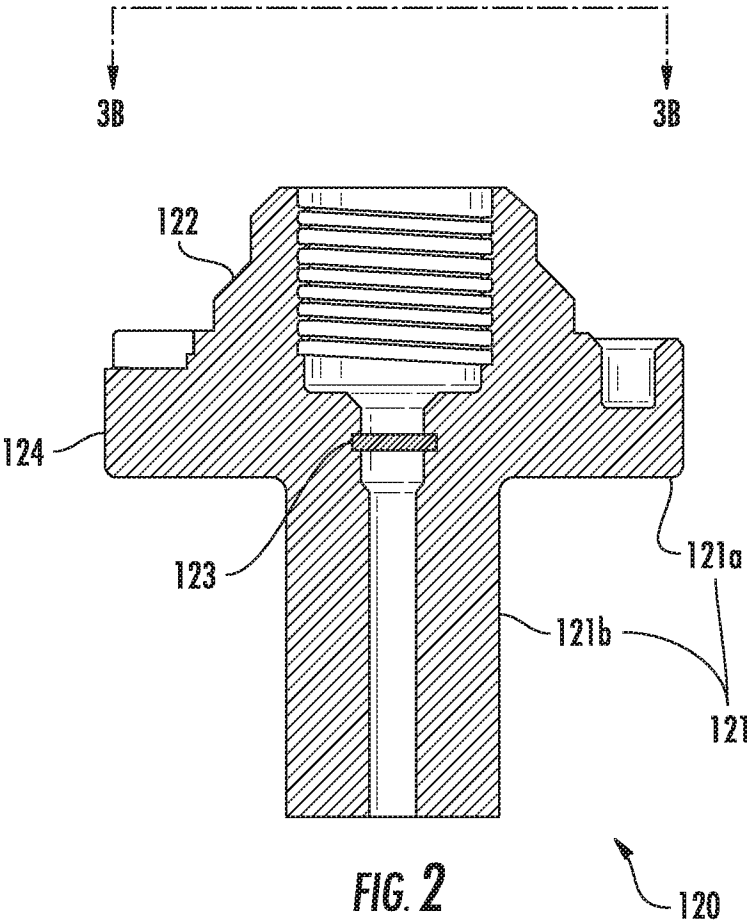
FIG. 2 illustrates a cross-sectional view of a tool dock of the combined multi-coupler.
Figure 1:
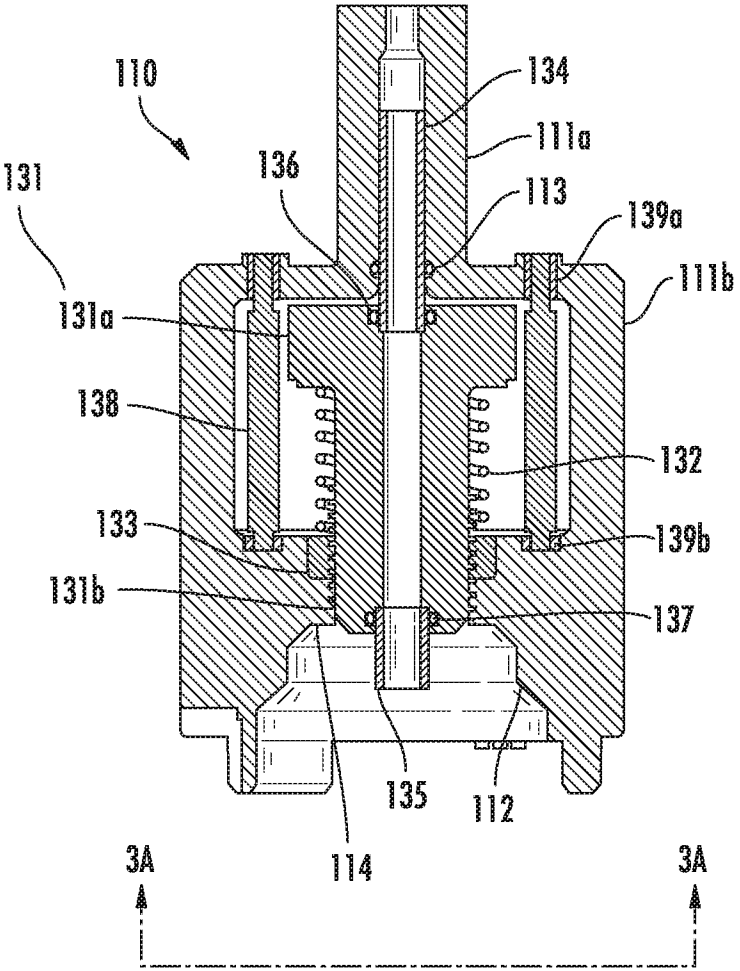
FIG. 1 illustrates a cross-sectional view of a coupler for a top drive of a combined multi-coupler, according to one embodiment.

FIGS. 1 and 2 illustrate a combined multi-coupler (CMC) system, according to one embodiment. The CMC includes a coupler 110 for a top drive, a tool dock 120, and a locking assembly. The coupler 110 may be configured to connect to the top drive or other traveling member. The coupler 110 may be integrally formed with the top drive or other traveling member. The coupler 110 may include a housing 111. The housing 111 may be tubular having a bore therethrough. The housing 111 may include one or more sections 111*a,b*. The housing may have a tubular section 111*a* and a bell section 111*b*. The housing sections 111*a,b* may be integrally formed.

The housing section 111*a* may have a bore therethrough. An annular recess may be formed in an inner surface of the housing section 111*a* adjacent the bore. The annular recess may be configured to receive a seal 113. The seal 113 may be an elastomeric seal. The seal 113 may be an annular seal. The seal 113 may be configured to engage and seal against a sleeve 134. The seal 113 may be configured to prevent fluid within the bore of the housing section 111*a* from entering a bore of the housing section 111*b*. The bore of the housing section 111*b* may be greater than the bore of the housing section 111*a*. The housing section 111*b* may include a stepped cone profile 112. The stepped cone profile 112 may be formed along an inner surface of the housing section 111*b*. The stepped cone profile 112 may be disposed adjacent an opening of the bore of the housing section 111*b*. The stepped cone profile 112 may have a shoulder 114 formed at a longitudinal end thereof. The shoulder 114 may have a threaded surface formed along an inner surface thereof. The threaded surface may have female threads. The female threads may be trapezoidal, such as stub acme threads.

The tool dock 120 may be configured to connect to the tool. The tool dock 120 may be integrally formed with the tool. The tool dock 120 may include an adapter 121. The adapter 121 is configured to be inserted into the housing 111. The adapter 121 may be tubular and have a bore therethrough. The adapter 121 may include one or more sections 121*a,b*. A bore of the adapter section 121*a* may be larger than a bore of the adapter section 121*b*. Adapter section 121*a* may include a stepped cone 122. The stepped cone profile 112 of the housing section 111*b* may be configured to receive the stepped cone 122. An inner surface of the stepped cone 122 may include female threads. The female threads may be trapezoidal, such as stub acme threads. The adapter section 121*a* may have a shoulder 124 formed at a longitudinal end thereof. A recess may be formed in the bore of the adapter section 121*a*. The recess may be configured to receive a seal 123. The seal 123 may be an elastomeric seal. The seal 123 may be an annular seal. The seal 123 may be configured to engage and seal against a second sleeve 135. The adapter section 121*b* may be configured to connect to the tool.

The locking assembly may include a lock member, such as lock pin 131, a biasing member, such as spring 132, an actuator, a thrust bearing 133, a first sleeve 134, and a second sleeve 135. The lock pin 131 may be tubular having a bore therethrough. The lock pin 131 may be at least partially disposed in the bore of the housing 111. The lock pin 131 may be longitudinally movable relative to the housing 111. The lock pin 131 may be longitudinally movable within the bore of the housing between an unlocked position (FIG. 5B) and a locked position (FIG. 5D). The lock pin may be configured to longitudinally couple the housing 111 and the adapter 121 in the locked position. The lock pin 131 may include a gear section 131*a* and a screw section 131*b*. The gear section 131*a* may have a larger diameter than the screw section 131*b*. The gear section 131*a* may have gear teeth disposed along an outer circumference. The gear section 131*a* may have a bore therethrough. A recess may be formed through an inner wall of the gear section 131*a* adjacent the bore. The recess may be configured to receive a seal 136. The screw section 131*b* may have a threaded surface formed about an outer circumference thereof. The threaded surface may include male threads. The male threads may be trapezoidal, such as stub acme threads. The male threads may correspond to and be configured to engage the female threads of the adapter 121 and the shoulder 114 of the housing section 111*b*. The male and female threads may be configured to transfer the weight of the tool dock 120 and a connected tool to the top drive or other traveling member. The male threads may be configured to support the weight of the tool dock 120 and a connected tool. The male threads may begin at a lower longitudinal end of the screw section 131*b* and extend longitudinally along the outer circumference towards the gear section 131*a*. The male threaded surface may be configured to extend longitudinally along the outer circumference of the screw section 131*b* at least as long as the combined length of the female threads of the adapter 121 and the shoulder 114 of the housing section 111*b*.

Alternatively, the male threaded surface may be formed on the adapter 121 and the female threaded surface formed on the lock pin 131.

The spring 132 may be disposed around the screw section 131*b*. The spring 132 may be disposed between a lower longitudinal end of the gear section 131*a* and the thrust bearing 133. The spring 132 may bias the lock pin 131 towards the unlocked position. The thrust bearing 133 may be disposed adjacent the shoulder 114 of the housing section 111*b*. The thrust bearing 133 may facilitate rotation of the lock pin 131 relative to the housing 111. The thrust bearing 133 may be configured to receive a thrust load from the tool while the tool and top drive are longitudinally coupled by the locking assembly.

The first sleeve 134 may be disposed in the bore of the housing 111. The first sleeve 134 may be at least partially disposed in the bore of the lock pin 131. The first sleeve 134 may be connected to the lock pin 131. The first sleeve 134 may be longitudinally movable with the lock pin 131. The first sleeve 134 may be longitudinally movable relative to the housing 111. The first sleeve 134 may be disposed at an upper end of the lock pin 131. The first sleeve 134 may be configured to be at least partially disposed in the bore of the housing section 111*a* while moving longitudinally relative to the housing 111. The first sleeve 134 may be a sufficient length to remain at least partially disposed within the bore of the housing section 111*a* while the lock pin 131 moves the first sleeve 134. The first sleeve 134 may be configured to provide fluid communication between the bore of the housing section 111*a* and the lock pin 131. Seal 113 may be disposed between an outer surface of the first sleeve 134 and the inner surface of the bore of the housing section 111*a*. Seal 136 may be disposed between an outer surface of the first sleeve 134 and the inner surface of the bore of the lock pin 131. The first sleeve 134 and seals 113, 136 may be configured to prevent fluid from entering an annulus in the bore of the housing section 111*b* between the lock pin 131 and the inner wall of the bore of the housing section 111*b*.

Second sleeve 135 may be disposed at a lower end of the lock pin 131. The second sleeve 135 may be at least partially disposed in the bore of the lock pin 131. The second sleeve 135 may be connected to the lock pin 131. The second sleeve 135 may be longitudinally movable relative to the housing 111. The second sleeve 135 may be longitudinally movable with the lock pin 131. The second sleeve 135 may be at least partially disposed in a bore of the stepped cone profile 112. The second sleeve 135 may be configured to provide fluid communication between the bore of the lock pin 131 and the bore of the adapter 121. Seal 137 may be disposed in a recess of the lock pin 131 adjacent the second sleeve 135. The seal 137 may be configured to seal against an outer surface of the second sleeve 135. The bore of the adapter section 121*a* may be configured to receive the second sleeve 135. The bore of the adapter section 121 may have a smaller diameter than the bore of the stepped cone 122. Seal 123 may be configured to seal against the outer surface of the second sleeve 135 when the second sleeve 135 is disposed in the bore of the adapter section 121*a*. The second sleeve 135 and seal 137 may be configured to prevent fluid from entering an annulus between the second sleeve 135 and the stepped cone profile 112. The second sleeve 135 and seal 123 may be configured to prevent fluid from entering an annulus between the second sleeve 135 and the bore of the adapter section 121*a*.

The actuator may include at least one actuating gear 138, radial bearings 139*a,b*, and a motor (not shown). The actuating gear 138 may be at least partially disposed within the bore of the housing section 111*b*. The actuating gear 138 may be configured to rotate relative to the housing 111. The actuating gear 138 may be configured to connect to the motor at a longitudinal end thereof. The actuating gear 138 may have gear teeth formed along an outer circumference thereof. The gear teeth of the actuating gear 138 may correspond with and engage the gear teeth of the gear section 131*a*. The actuating gear 138 may be configured to actuate the lock pin 131. The actuating gear 138 may rotate the lock pin 131 relative to the housing 111. The motor may be disposed on an outer surface of the housing 111. Alternatively, the motor may be disposed on the top drive. The motor may be an electric motor. The motor may be configured to rotate the actuating gear 138 relative to the housing 111. Radial bearings 139*a,b* may facilitate rotation of the actuating gear 138. The bearing 139*a* may be disposed at a longitudinal end of the actuating gear 138 adjacent the motor. The bearing 139*a* may be disposed about a circumference of the actuating gear 138. The bearing 139*b* may be disposed at a longitudinal end of the actuating gear 138 opposite the bearing 139*b*. The bearing 139*b* may be received in a recess formed in the housing section 111*b*. The bearing 139*b* may be disposed about a circumference of the actuating gear 138.

Figure 3B:
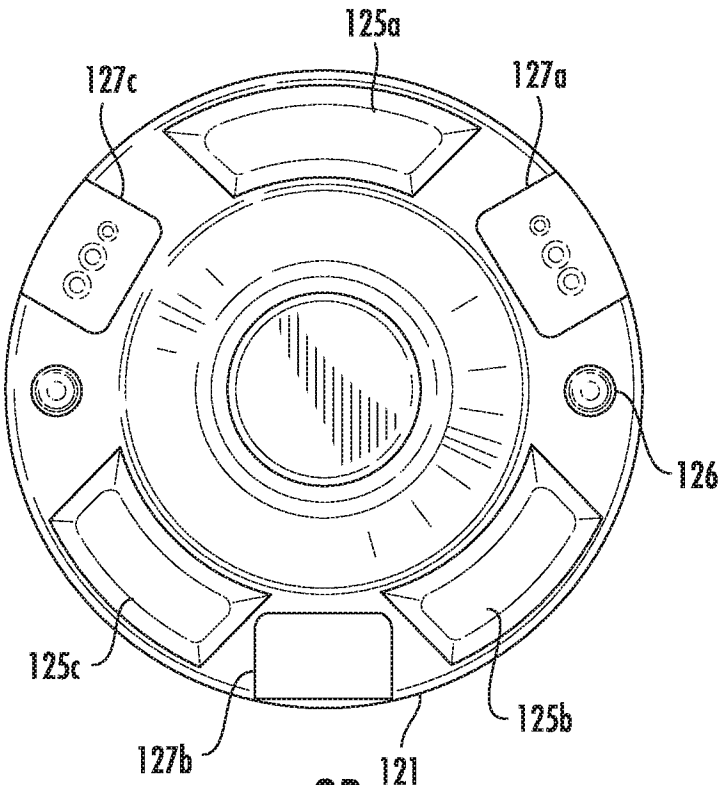
FIG. 3B illustrates a top down view of the tool dock of the combined multi-coupler.
Figure 3A:
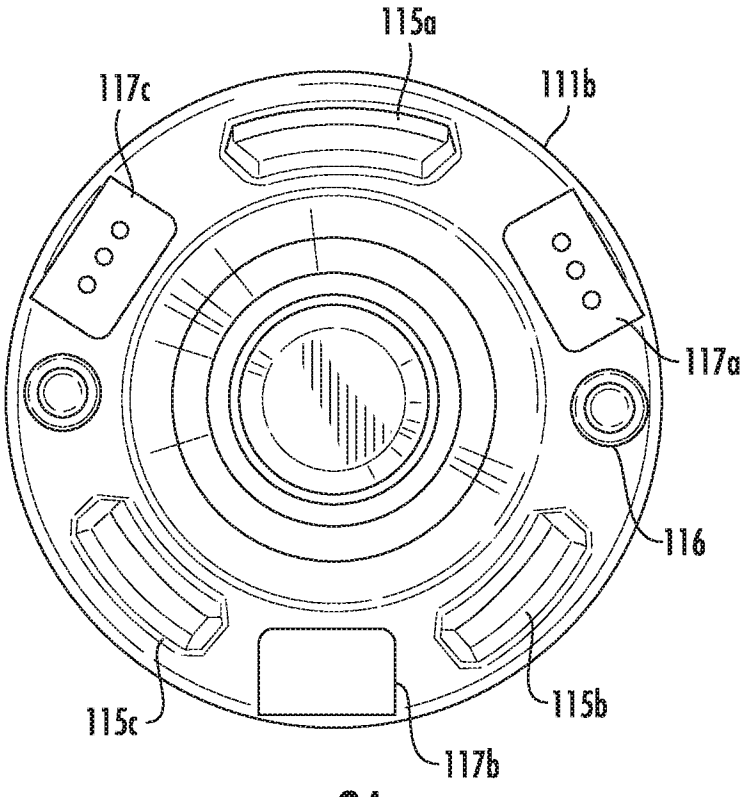
FIG. 3A illustrates a bottom-up view of the coupler for a top drive of the combined multi-coupler.

FIG. 3A illustrates a bottom-up view of the top drive coupler 110 of the CMC. The housing section 111*b* may have a locating hole 116 formed through a wall thereof. The locating hole 116 may extend at least partially longitudinally into the housing section 111*b*. The locating hole 116 may have a stepped profile. The locating hole 116 may be configured to receive a locating pin 126 of the tool dock 120. Utility modules 117*a-c* may be disposed in a bottom surface of the housing section 111*b*. The utility modules 117*a-c* may be configured to transfer data, power, hydraulics, electric, and/or pneumatics between the top drive coupler 110 and the tool dock 120. Torque keys 115*a-c* may be formed along the bottom surface of the housing section 111*b*. Torque keys 115*a-c* may extend longitudinally from the bottom surface of the housing section 111*b*. Torque keys 115*a-c* may be trapezoidal in shape. Torque key 115*a* may have a larger cross-sectional area than torque keys 115*b,c*. The differing areas of the torque keys 115*a-c* may facilitate alignment of the top drive coupler 110 and the tool dock 120.

FIG. 3B illustrates a top-down view of the adapter 121 of the tool dock 120. The adapter 121 may include a locating pin 126 formed at a longitudinal end thereof. The locating pin 126 may extend longitudinally away from the adapter 121. The locating pin 126 and locating hole 116 may facilitate alignment of the top drive coupler 110 and the tool dock 120. Torque slots 125*a-c* may be formed at a longitudinal end of the adapter 121. The torque slots 125*a-c* may extend partially through an outer surface of the adapter 121. Torque slots 125*a-c* may correspond to the torque keys 115*a-c*, respectively. Torque slot 125*a* may be configured to receive the torque key 115*a*. The torque slots 125*a-c* and torque keys 115*a-c* may be configured to provide bidirectional rotational coupling between the housing 111 and the tool dock 120. Engagement of the torque slots 125*a-c* with the torque keys 115*a-c* may torsionally couple the top drive to the tool. Utility connectors 127*a-c* may be disposed at a longitudinal end of the adapter adjacent the torque slots 125*a-c*. Utility connectors 127*a-c* may be configured to connect to corresponding utility modules 117*a-c*. The utility connectors 127*a-c* and utility modules 117*a-c* may be configured to transfer data, power, hydraulics, electric and/or pneumatics between the tool and the top drive. The torque keys 115*a-c* may be configured to align the utility modules 117*a-c* and the corresponding utility connectors 125*a-c*.

Figure 4B:
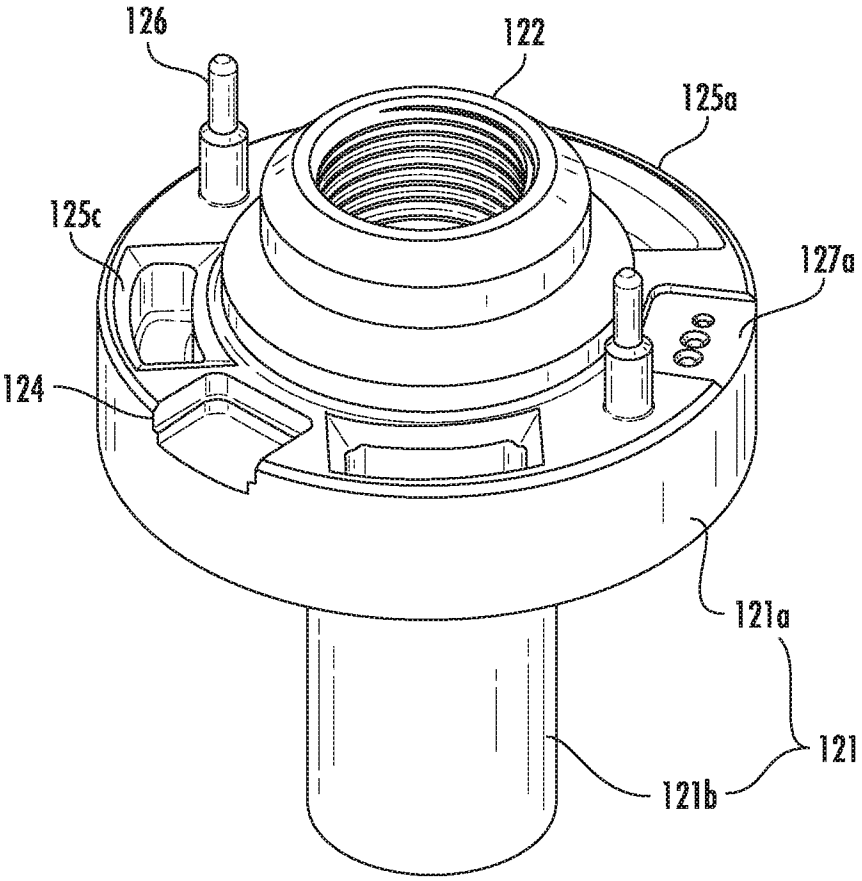
FIG. 4B illustrates an isometric view of the tool dock of the combined multi-coupler.
Figure 4A:
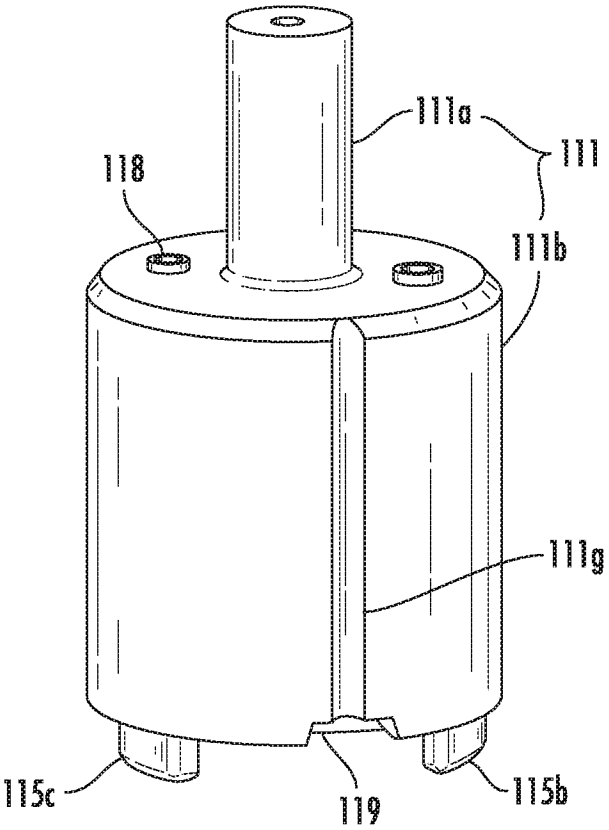
FIG. 4A illustrates an isometric view of the coupler for a top drive of the combined multi-coupler.

FIG. 4A illustrates an isometric view of the top drive coupler 110. The housing section 111*b* may have a groove 111*g* formed along an outer surface thereof. The groove 111*g* may be configured to receive a supply line. The supply line may be configured to transfer power, data, hydraulics, electric, and/or pneumatics between the top drive and the utility modules 117*a-c*. A recess 119 may be formed through the outer wall of the housing 111*b*. The recess 119 may be aligned with the groove 111*g*. The recess 119 may be configured to receive the utility module 117*b*. Corresponding recesses may be formed through the outer wall of the housing section 111*b* spaced circumferentially around the housing section 111*b* from the recess 119. The corresponding recesses may be configured to receive corresponding utility modules 117*a,c*. Utility module 117*b* may be aligned with the groove 111*g* formed along the outer surface of the housing section 111*b*. Utility module 117*b* may be configured to connect to the supply line disposed in the groove 111*g*. Utility modules 117*a,c* may be aligned with corresponding grooves formed along the outer surface of the housing section 111*b*. Utility modules 117*a,c* may be configured to connect to corresponding supply lines disposed in the grooves. At least one port 118 may be formed through a wall of the housing section 111*b*. The at least one port 118 may be formed through an upper wall of the housing section 111*b*. A longitudinal end of the actuating gear 138 may be at least partially disposed in the at least one port 118 of the housing section 111*b*. The bearing 139*a* may be at least partially disposed in the at least one port 118 of the housing section 111*b*. Torque keys 115*a-c* may be formed at a longitudinal end of the housing section 111*b*. The torque keys 115*a-c* may project longitudinally from the lower longitudinal end of the housing section 111*b*.

FIG. 4B illustrates an isometric view of the tool dock 120. The adapter section 121*a* may include a recess 124 formed at an upper surface. The recess 124 may be formed partially through an outer circumference of the adapter section 121*a*. The recess 124 may be configured to receive the utility connector 127*b*. Corresponding recesses may be formed at the upper surface of the adapter section 121*a* and spaced circumferentially around the adapter section 121*a* from the recess 124. The corresponding recesses may be configured to receive the corresponding utility connectors 127*a,c*. The locating pin 126 may extend longitudinally from the upper surface of the adapter section 121*a*. A second locating pin may extend longitudinally from the upper surface of the adapter section 121*a* and be spaced circumferentially apart from the locating pin 126. The locating pin 126 may have a stepped profile corresponding to the stepped profile of the locating hole 116.

Alternatively, the torque keys may be formed on the adapter of the tool. The torque slots may be formed on the housing of the top drive coupler.

FIGS. 5A-5D illustrate operation of the CMC 100. First, the adapter 121 is aligned with and inserted into the bore of the housing 111. The top drive coupler 110 may be moved by the traveling member over the tool dock 120. The tool dock 120 may be raised and/or the top drive coupler 110 lowered to begin the process. As the adapter 121 is inserted into the bore of the housing 111, the stepped cone 122 of the adapter 121 and stepped cone profile 112 facilitate alignment of the top drive coupler 110 and the tool dock 120. The stepped cone 122 is received within the stepped cone profile 112. The locating pin 126 and locating hole 116 further facilitate alignment of the top drive coupler 110 and the tool dock 120. The locating pin 126 is received in the locating hole 116. Finally, the differing sizes of the torque keys 115*a-c* ensures the correct utility modules 117*a-c* are aligned with the corresponding utility connectors 127*a-c*.

Figure 5B:
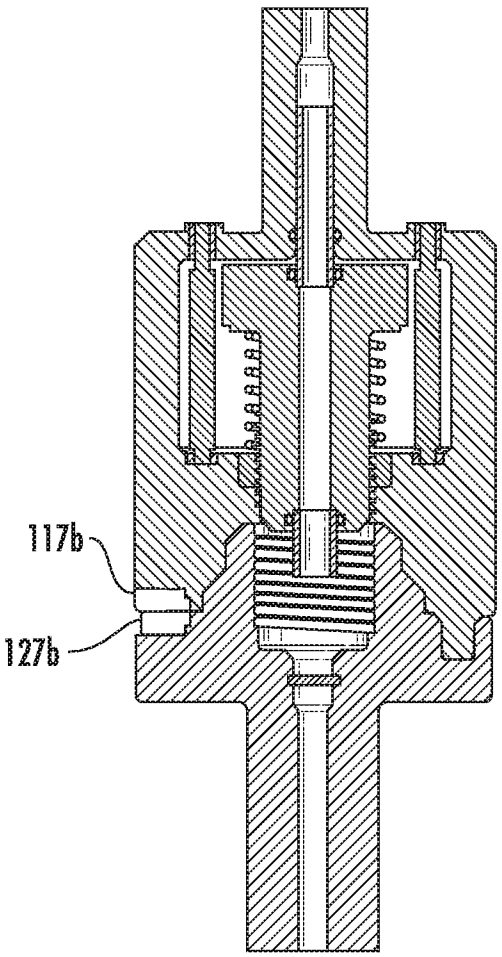
FIGS. 5A-D illustrate operation of the combined multi-coupler.
Figure 5A:
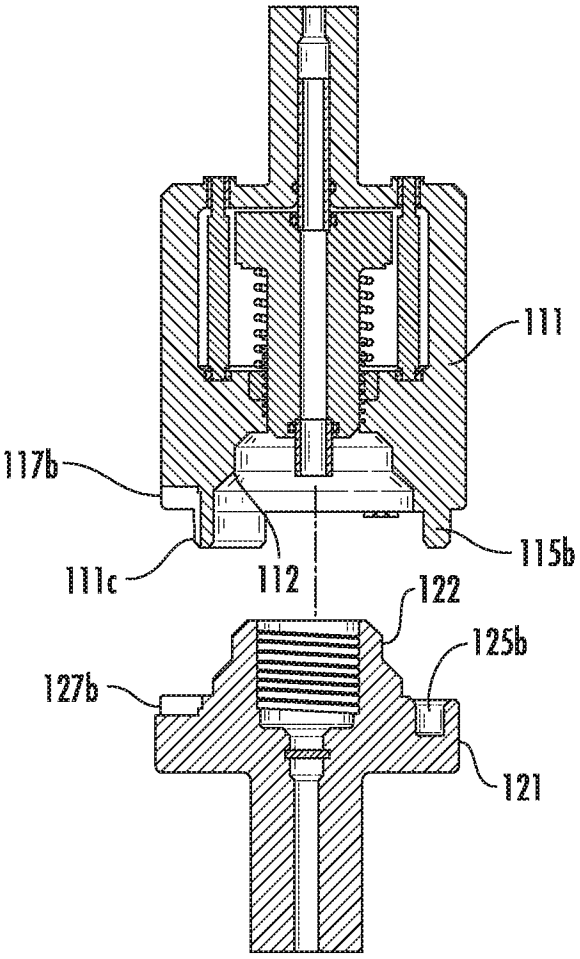
Figure 5D:
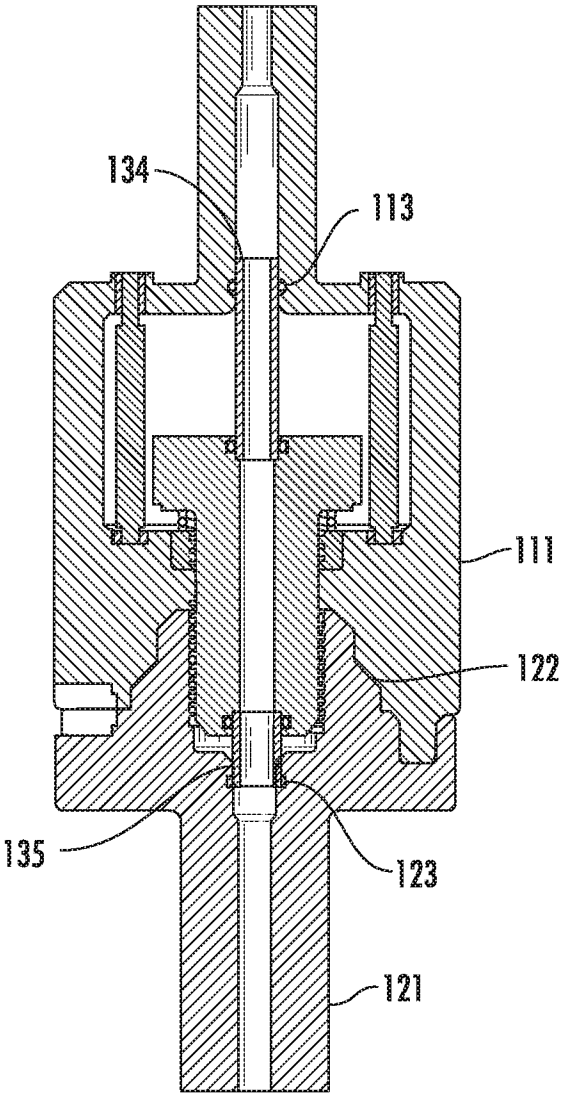

FIG. 5B illustrates the adapter 121 inserted into the bore of the housing 111. The torque keys 115*a-c* enter the corresponding torque slots 125*a-c*, thereby providing bidirectional torsional coupling between the top drive coupler 110 and the tool dock 120. The utility modules 117*a-c* connect to the corresponding utility connectors 127*a-c*, thereby providing data, power, hydraulics, electric and/or pneumatics transfer between the top drive coupler 110 and the tool dock 120. The lock pin 131 is in the unlocked position.

Figure 5C:
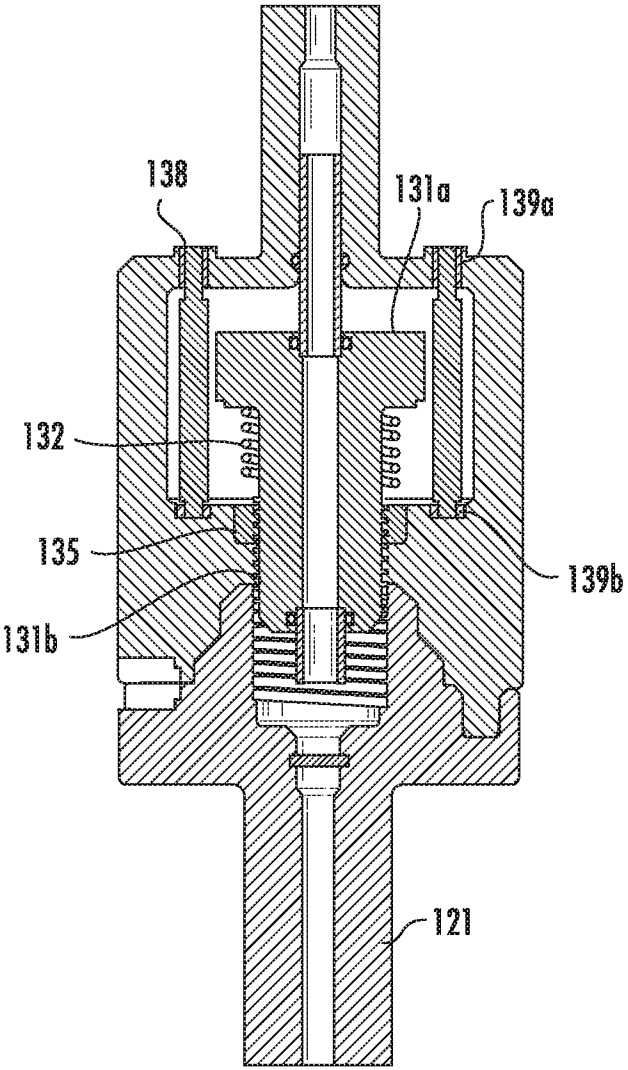

FIG. 5C illustrates operation of the locking assembly of the CMC to longitudinally couple the housing 111 and the adapter 121. Once the adapter 121 is fully inserted into the housing 111 of the top drive coupler 110, the motor is actuated to begin the process of longitudinally coupling the top drive coupler 110 and the tool dock 120. The motor rotates the actuating gear 138 relative to the housing 111. The gear teeth of the actuating gear 138 engage corresponding gear teeth on the gear section 131*a* of the lock pin 131. The lock pin 131 rotates relative to the housing 111. The male threads of the screw section 131*b* move through the female threads of the shoulder 114 of the housing 111. The lock pin 131 moves longitudinally through the bore of the housing 111 until reaching the lower end of the shoulder 114. The male threads of the screw section 131*b* catch and engage the female threads of the adapter 121. Engagement of the male threads and the female threads longitudinally moves the lock pin 131 relative to the housing 111. The lock pin 131 moves longitudinally against the biasing force of the spring 132. The lock pin 131 moves longitudinally through the bore of the adapter 121 until reaching a lower end of the bore of the stepped cone 122. The sleeves 134, 135 move longitudinally with the lock pin 131. The sleeves 134, 135 and the bore of the lock pin 131 fluidly couple the top drive and the tool dock. Drilling fluid may be pumped from the top drive through the housing 111 and the adapter 121 to the tool when the lock pin 131 is in the locked position.

The lock pin 131 has moved to the locked position, as shown in FIG. 5D. The first sleeve 134 is at least partially disposed in the bore of the housing section 111*a*. The second sleeve 135 is at least partially disposed in the bore of the adapter section 121*a*. The seal 123 engages the outer surface of the second sleeve 135. The male and female threads provide longitudinal coupling between the top drive coupler 110 and the tool dock 120. Engagement of the male and female threads may provide support for a weight of the tool dock 120 and a connected tool.

In order to decouple the adapter 121 and the housing 111, the process described above is reversed. The motor rotates the actuating gear 138 in an opposite direction as the coupling process. The rotation of the actuating gear 138 causes the lock pin 131 to rotate in an opposite direction from before. The lock pin 131 moves longitudinally relative to the housing 111 and away from the adapter 121. The male threads of the lock pin 131 move through the female threads of the adapter 121 until the lock pin 131 returns to the unlocked position shown in FIG. 5B. Next, the adapter 121 and the housing 111 are separated. The utility modules 117*a-c* disconnect from the utility connectors 127*a-c*. The torque keys 115*a-c* move out of the corresponding torque slots 125*a-c*, thereby torsionally decoupling the adapter 121 and the housing 111.

In one or more of the embodiments described herein, a coupler for a top drive includes a housing having a bore therethrough, a lock member at least partially disposed within the bore of the housing and longitudinally movable relative to the housing between a locked position and an unlocked position, and an actuator at least partially disposed within the housing and configured to move the lock member.

In one or more of the embodiments described herein, the lock member is rotatable relative to the housing.

In one or more of the embodiments described herein, the lock member is at least partially disposed within an adapter of a tool in the locked position.

In one or more of the embodiments described herein, the lock member is configured to longitudinally couple the housing and an adapter of a tool in the locked position.

In one or more of the embodiments described herein, the coupler for a top drive includes a biasing member disposed within the bore of the housing and configured to bias the lock member towards the unlocked position.

In one or more of the embodiments described herein, the coupler for a top drive includes a utility module disposed on an outer surface of the housing and configured to transfer at least one of power, data, hydraulics, electric, and pneumatics to a tool.

In one or more of the embodiments described herein, the actuator includes a gear rotatable relative to the housing to longitudinally move the lock member.

In one or more of the embodiments described herein, the coupler for a top drive includes a torque key formed on an outer surface of the housing and configured to provide torsional coupling between the housing and an adapter of a tool.

In one or more of the embodiments described herein, a combined multi-coupler system includes a coupler having a housing with a bore therethrough, an adapter of a tool, and a lock member at least partially disposed within the bore of the housing and longitudinally movable relative to the housing to couple the housing and the adapter.

In one or more of the embodiments described herein, the adapter is configured to be inserted into the housing.

In one or more of the embodiments described herein, the combined multi-coupler system includes a utility module disposed on an outer surface of the housing, and a utility connector disposed on an outer surface of the adapter, wherein the utility connector is configured to connect to the utility module.

In one or more of the embodiments described herein, the combined multi-coupler includes a torque key formed on the housing, and a torque slot formed through a wall of the adapter and configured to receive the torque key.

In one or more of the embodiments described herein, the lock member includes a lock pin rotatable relative to the housing.

In one or more of the embodiments described herein, the lock member is longitudinally movable between a locked position and an unlocked position.

In one or more of the embodiments described herein, the lock member is engaged with the adapter in the locked position.

In one or more of the embodiments described herein, the lock member is configured to longitudinally couple the housing and the adapter in the locked position.

In one or more of the embodiments described herein, the lock member includes a first threaded surface.

In one or more of the embodiments described herein, the adapter includes a second threaded surface.

In one or more of the embodiments described herein, the first threaded surface is configured to engage the second threaded surface.

In one or more of the embodiments described herein, the first threaded surface is configured to support a weight of the adapter and the tool.

In one or more of the embodiments described herein, a method for coupling a top drive to a tool includes inserting an adapter of a tool into a housing of a coupler for a top drive, moving a lock member longitudinally relative to the housing, and engaging the adapter with the lock member to couple the adapter and the housing.

In one or more of the embodiments described herein, the method includes rotating the lock member relative to the housing to move the lock member longitudinally.

In one or more of the embodiments described herein, the method includes engaging a torque slot of the adapter with a torque key of the housing, thereby torsionally coupling the adapter and the housing.

In one or more of the embodiments described herein, the method includes rotating an actuating gear to move the lock member.

In one or more of the embodiments described herein, the method includes transferring at least one of power, data, hydraulics, electric, and pneumatics between the adapter and the housing.

While the foregoing is directed to embodiments of the present invention, other and further embodiments of the invention may be devised without departing from the basic scope thereof, and the scope thereof is determined by the claims that follow.

The invention claimed is:

1. A coupler for a top drive, comprising:

a housing;

a lock member at least partially disposed within the housing and longitudinally movable relative to the housing between a locked position and an unlocked position, the lock member having a bore, the housing having an axial central bore having an inside diameter in fluid communication with the bore of the lock member; and an actuator at least partially disposed within the housing and configured to rotate the lock member, thereby longitudinally moving the lock member relative to the housing.

2. The coupler of claim 1, wherein the lock member is rotatable relative to the housing.

3. The coupler of claim 1, wherein the lock member is engaged within an adapter of a tool in the locked position.

4. The coupler of claim 1, wherein the lock member is configured to longitudinally couple the housing and an adapter of a tool in the locked position.

5. The coupler of claim 1, further comprising a biasing member configured to bias the lock member towards the unlocked position.

6. The coupler of claim 1, further comprising a utility module coupled to the housing and configured to transfer at least one of power, data, hydraulics, electric, and pneumatics to a tool.

7. The coupler of claim 6, further comprising a torque key formed on an outer surface of the housing and configured to engage a slot in an adapter of a tool to provide torsional coupling between the housing and the adapter.

8. The coupler of claim 7, wherein the torque key is configured to align the utility module and a utility connector of the adapter.

9. The coupler of claim 1, the actuator further comprising a gear rotatable relative to the housing to longitudinally move the lock member.

10. A combined multi-coupler system, comprising:

a coupler for a top drive having a housing;

an adapter of a tool, the adapter having a bore; and a lock member at least partially disposed within the housing and longitudinally movable relative to the housing to connect the housing to the adapter, the lock member having a bore, the housing having an axial central bore having an inside diameter in fluid communication with the bore of the lock member and the bore of the adapter.

11. The combined multi-coupler system of claim 10, wherein the adapter is configured to be inserted into the housing.

12. The combined multi-coupler system of claim 10, further comprising:

a utility module disposed on an outer surface of the housing; and a utility connector disposed on an outer surface of the adapter, wherein the utility connector is configured to connect to the utility module.

13. The combined multi-coupler system of claim 10, further comprising:

a torque key formed on the housing; and a torque slot formed through a wall of the adapter and configured to receive the torque key.

14. The combined multi-coupler system of claim 10, the lock member is rotatable relative to the housing while moving longitudinally relative to the housing.

15. The combined multi-coupler system of claim 14, further comprising an actuator at least partially disposed within the housing and configured to engage a gear of the lock member to rotate the lock member relative to the housing.

16. The combined multi-coupler system of claim 15, further comprising a torque key formed on an outer surface of the housing and configured to engage a slot in the adapter of a tool to provide torsional coupling between the housing and the adapter.

17. The combined multi-coupler system of claim 10, wherein the lock member is longitudinally movable between a locked position in which the lock member is attached to the adapter, and an unlocked position in which the adapter is released from the lock member.

18. The combined multi-coupler system of claim 10, further comprising:

the lock member having a first threaded surface;

the adapter having a second threaded surface, wherein the first threaded surface is configured to engage the second threaded surface when the lock member moves longitudinally relative to the housing.

19. The combined multi-coupler system of claim 18, wherein the first threaded surface is configured to support a weight of the adapter and the tool.

20. A method for coupling a top drive to a tool, comprising:

inserting an adapter of a tool into a housing of a coupler for a top drive, the adapter having a bore;

moving a lock member longitudinally relative to the housing; and connecting the adapter with the lock member to attach the adapter to the housing while moving the lock member longitudinally, whereby a bore of the lock member is placed in fluid communication with an inside diameter of the bore of the adapter.

21. The method of claim 20, further comprising rotating the lock member relative to the housing to move the lock member longitudinally.

22. The method of claim 20, further comprising, while inserting the adapter into the housing, engaging a torque slot of the tool with a torque key of the housing, thereby torsionally coupling the adapter and the housing.

23. The method of claim 20, further comprising rotating an actuating gear to move the lock member.

24. The method of claim 20, further comprising transferring at least one of power, data, hydraulics, electric, and pneumatics between the adapter and the housing.

* * * * *